US009224564B2

(12) United States Patent
Enriquez et al.

(10) Patent No.: US 9,224,564 B2
(45) Date of Patent: Dec. 29, 2015

(54) FUSE WITH COUNTER-BORE BODY

(75) Inventors: Albert Enriquez, Bulacan (PH); Cherry Malabanan, Tanauan (PH); Richard Tacla, Batangas (PH)

(73) Assignee: LITTELFUSE, INC., Chicago, IL (US)

( * ) Notice: Subject to any disclaimer, the term of this patent is extended or adjusted under 35 U.S.C. 154(b) by 576 days.

(21) Appl. No.: 13/152,132

(22) Filed: Jun. 2, 2011

(65) Prior Publication Data

US 2011/0298577 A1 Dec. 8, 2011

Related U.S. Application Data

(60) Provisional application No. 61/351,472, filed on Jun. 4, 2010.

(51) Int. Cl.

| | |
|---|---|
| ***H01H 85/04*** | (2006.01) |
| ***H01H 85/175*** | (2006.01) |
| ***H01H 85/041*** | (2006.01) |
| ***H01H 85/157*** | (2006.01) |
| *H01H 85/00* | (2006.01) |
| *H01H 85/165* | (2006.01) |

(52) U.S. Cl.

CPC ..... *H01H 85/175* (2013.01); *H01H 85/0418* (2013.01); *H01H 85/157* (2013.01); *H01H 85/003* (2013.01); *H01H 85/165* (2013.01)

(58) Field of Classification Search

CPC ... H01R 13/68; H01H 69/02; H01H 85/0417; H01H 85/046; H01H 85/165; H01H 85/2045; H01H 85/20; H01H 85/044; H01H 85/055; H01H 85/47; H01H 85/10; H01H 85/153; H01H 85/157; H01H 85/38; H01H 85/42; H01H 85/003; H01H 85/06; H01H 85/0418; H01H 85/175; H01H 85/0026

USPC ..... 337/187, 246, 248; 29/623

See application file for complete search history.

(56) References Cited

U.S. PATENT DOCUMENTS

| | | | | | |
|---|---|---|---|---|---|
| 1,114,654 | A | * | 10/1914 | Steelman | H01H 85/157 337/236 |
| 1,687,246 | A | | 10/1928 | Hickey | |
| 1,700,080 | A | * | 1/1929 | Sandin | 337/222 |
| 2,794,095 | A | * | 5/1957 | Kozacka | 337/244 |
| 2,913,555 | A | * | 11/1959 | McAlister | 337/164 |
| 3,156,801 | A | * | 11/1964 | Cole | H01H 85/143 337/161 |
| 3,460,086 | A | * | 8/1969 | Fister | 337/202 |
| 3,529,270 | A | * | 9/1970 | Kozacka | 337/232 |
| 3,644,861 | A | * | 2/1972 | Fister | 337/252 |
| 3,832,664 | A | * | 8/1974 | Wiebe | 337/241 |

(Continued)

FOREIGN PATENT DOCUMENTS

| | | |
|---|---|---|
| CN | 2549585 Y | 5/2003 |
| DE | 361049 | 10/1922 |

(Continued)

*Primary Examiner* — Anatoly Vortman

*Assistant Examiner* — Jacob Crum

(74) *Attorney, Agent, or Firm* — Kacvinsky Daisak Bluni PLLC

(57) ABSTRACT

An improved fuse having one or more counter bores in an interior wall of a hollow tube used as the fuse housing. The fuse includes a fusible element disposed within a cavity defined by the interior wall. The fusible element is electrically connected to first and second end caps via solder. The first and second end caps are attached to respective ends of the hollow tube. The one or more counter bores provide more space for the solder to cover the fusible element resulting in a more reliable electrical connection.

22 Claims, 4 Drawing Sheets

(56) References Cited

U.S. PATENT DOCUMENTS

| | | | | | |
|---|---|---|---|---|---|
| 3,878,423 | A | * | 4/1975 | Hill et al. | 313/267 |
| 3,914,863 | A | * | 10/1975 | Wiebe | 29/623 |
| 4,101,860 | A | * | 7/1978 | Fister | 337/159 |
| 4,135,175 | A | * | 1/1979 | Perreault | 337/248 |
| 4,158,187 | A | * | 6/1979 | Perreault | 337/248 |
| 4,159,458 | A | * | 6/1979 | Wiebe | 337/252 |
| 4,177,444 | A | * | 12/1979 | Taki | 337/163 |
| 4,205,431 | A | * | 6/1980 | Wiebe | 29/623 |
| 4,467,308 | A | * | 8/1984 | Arikawa et al. | 337/231 |
| 4,511,876 | A | * | 4/1985 | Urani | 337/244 |
| 4,562,420 | A | * | 12/1985 | Kowalik et al. | 337/165 |
| 4,563,809 | A | * | 1/1986 | Reeder | 29/623 |
| 4,656,453 | A | * | 4/1987 | Reeder | 337/236 |
| 4,703,299 | A | * | 10/1987 | Vermij | 337/158 |
| 4,920,327 | A | * | 4/1990 | Arikawa et al. | 337/231 |
| 5,214,406 | A | * | 5/1993 | Reese et al. | 337/231 |
| 5,235,307 | A | * | 8/1993 | Oh | 337/228 |
| 5,252,942 | A | | 10/1993 | Gurevich | |
| 5,642,090 | A | * | 6/1997 | Arikawa | 337/297 |
| 5,726,620 | A | * | 3/1998 | Arikawa | 337/227 |
| 5,898,358 | A | * | 4/1999 | Tompkins et al. | 337/163 |
| 5,963,123 | A | * | 10/1999 | Douglass | 337/254 |
| 5,994,994 | A | * | 11/1999 | Ito et al. | 337/248 |
| 6,037,854 | A | * | 3/2000 | Baker et al. | 337/405 |
| 6,147,585 | A | | 11/2000 | Kalra et al. | |
| 6,191,678 | B1 | * | 2/2001 | Edwards | 337/163 |
| 6,552,646 | B1 | * | 4/2003 | Wong | 337/252 |
| 6,774,760 | B2 | * | 8/2004 | Kalra et al. | 337/263 |
| 6,798,330 | B2 | * | 9/2004 | Arikawa et al. | 337/231 |
| 2002/0113684 | A1 | * | 8/2002 | Arikawa et al. | 337/163 |
| 2004/0021546 | A1 | * | 2/2004 | Nakano et al. | 337/186 |
| 2004/0104801 | A1 | | 6/2004 | Jollenbeck et al. | |
| 2004/0183646 | A1 | * | 9/2004 | Jollenbeck et al. | 337/228 |
| 2005/0035841 | A1 | * | 2/2005 | Kobayashi et al. | 337/157 |
| 2005/0168315 | A1 | * | 8/2005 | Brown et al. | 337/248 |
| 2008/0020647 | A1 | * | 1/2008 | Carter | 439/620.27 |
| 2008/0084267 | A1 | * | 4/2008 | Jollenbeck et al. | 337/246 |
| 2009/0072943 | A1 | * | 3/2009 | Aberin et al. | 337/186 |
| 2010/0245025 | A1 | * | 9/2010 | de Leon et al. | 337/290 |

FOREIGN PATENT DOCUMENTS

| | | | | | |
|---|---|---|---|---|---|
| EP | 423897 | A1 | * | 4/1991 | H01H 85/157 |
| JP | H0517903 | U | | 3/1993 | |

* cited by examiner

FUSE WITH COUNTER-BORE BODY

CROSS-REFERENCE TO RELATED APPLICATIONS

This is a non-provisional of pending U.S. Provisional Patent Application Ser. No. 61/351,472, filed Jun. 4, 2010, the entirety of which provisional application is incorporated by reference herein in its entirety.

BACKGROUND OF THE INVENTION

1. Field of the Invention

Embodiments of the invention relate to the field of circuit protection devices. More particularly, the present invention relates to a fuse having a hollow body that has counter-bored ends to aid in the connection of the fusible element to respective fuse terminals.

2. Discussion of Related Art

Fuses are used as circuit protection devices and form an electrical connection with a component in a circuit to be protected. A fuse includes a hollow fuse body, a fusible element disposed within the hollow body, and two end caps each connected to an end of the fusible element. In particular, FIG. 1 illustrates a prior art fuse 10 having a hollow tubular body 15, a first end cap or terminal 20 and a second end cap or terminal 25. The fusible element 30 is disposed within the hollow body 15 and connects end cap 20 and 25. When an occurrence of a specified fault condition occurs, the fusible element 30 melts or otherwise opens to interrupt the circuit path and isolate the protected electrical components or circuit from potential damage. The hollow tubular body 15 may be ceramic capable of withstanding heat generated when the fuse is blown.

When assembling this type of fuse, consistency and reliability of the solder bonds (as referenced at areas A in FIG. 1) between the fusible element 30 and the end caps 20 and 25 are very important in order to create a robust electrical connection between the terminals. Unfortunately, during assembly there isn't a consistent location where the solder will reflow to achieve a consistent wire to solder connection. In particular, inspection of these fuses occasionally reveals fuses which have inferior wire-to-solder bonds. Thus, there is a need to provide a hollow body fuse configuration that accommodates improved wire to solder connections to repeatedly produce a reliable fuse.

SUMMARY OF THE INVENTION

Exemplary embodiments of the present invention are directed to an improved fuse having counter bores in walls of a hollow tube used as the fuse housing to provide more space for the solder to cover the fusible element resulting in a more reliable electrical connection. In an exemplary embodiment, the fuse includes a hollow body having two ends where each of the ends has a counter bore configured to receive solder. A fusible element passes through the body. A first and second caps, each disposed on respective ends of the hollow body, wherein the solder forms an electrical connection between each of the caps and the fusible element.

In another embodiment, the fuse includes a hollow body having an interior wall that defines a central cavity where the hollow body has a first end and a second end. A counter bore is disposed within the interior wall at the first end of the hollow body. A solder material is disposed within the counter bore and a fusible element is disposed within the central cavity and extends from the first end of the hollow body to the second end of the hollow body. The fusible element has a first end attached to the solder material proximate the counter bore. The fuse also includes a cap which is attached to the first end of the hollow body where the solder material forms an electrical connection between the cap and the first end of the fusible element.

DESCRIPTION OF EMBODIMENTS

Figure 1:
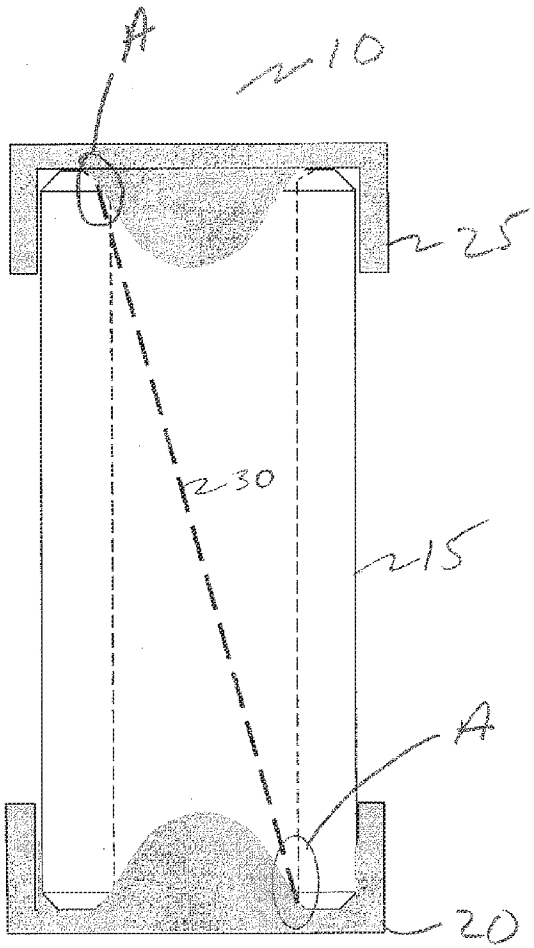
Fig. 1 (Prior Art)
FIG. 1 illustrates a prior art fuse.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

Figure 2C:
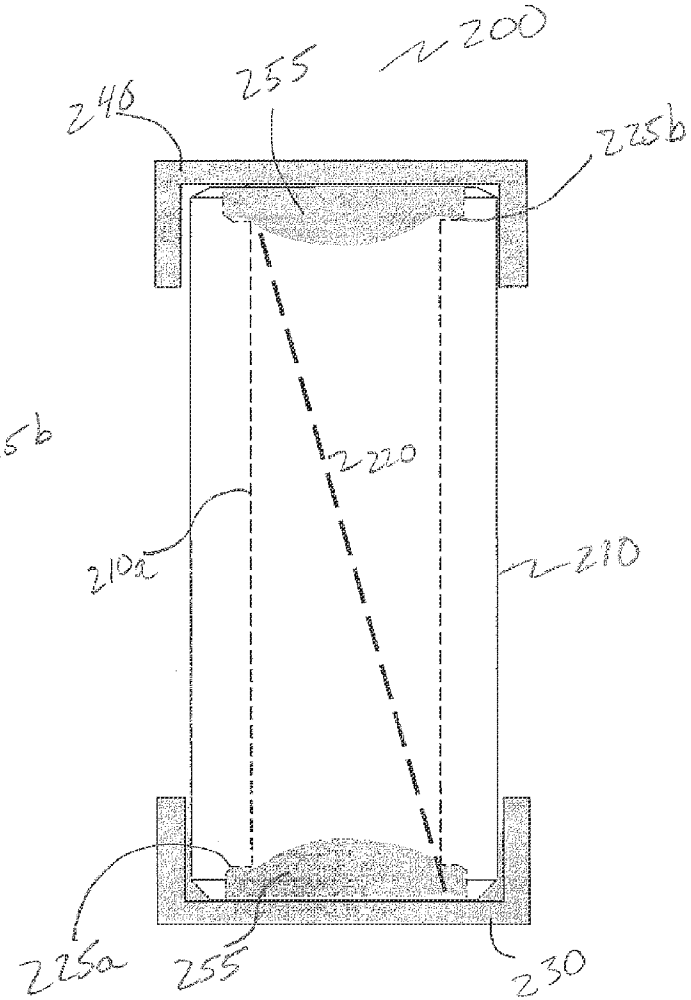
FIG. 2C illustrates a side view of a fuse utilizing the fuse body of FIGS. 2A-2B in accordance with an embodiment of the present disclosure.
Figure 2B:
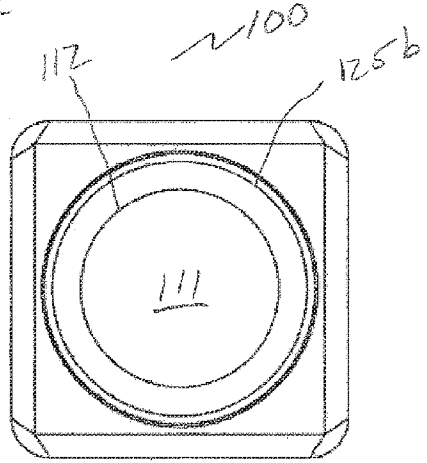
FIG. 2B illustrates an end view of the fuse body of FIG. 2A in accordance with an embodiment of the present disclosure.
Figure 2A:
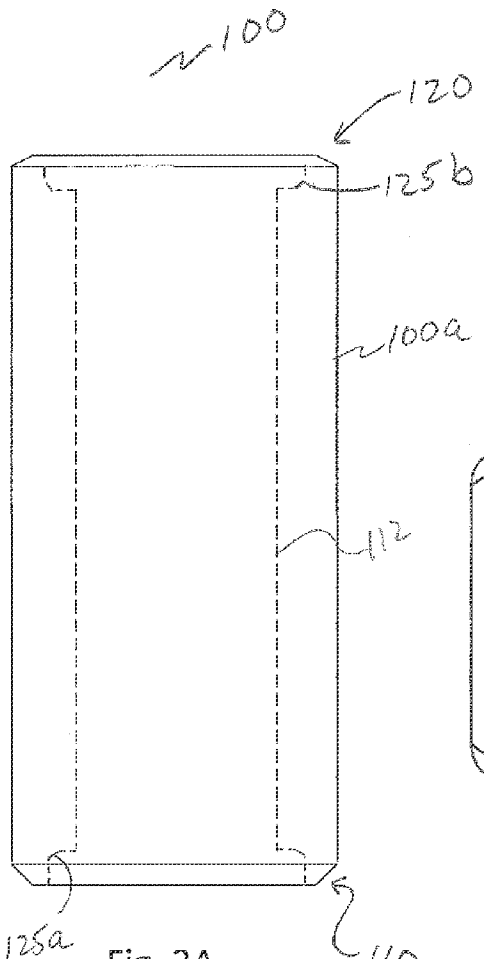
FIG. 2A illustrates a side view of a fuse body in accordance with an embodiment of the present disclosure.

FIG. 2A is a perspective view of a hollow fuse body or tube 100 used for a fuse having walls 100*a*, a first end 110 and a second end 120. The tube 100 has a generally cylindrical shape which can have a desired cross sectional profile as shown, for example, in FIG. 2B. A cavity 111 is defined by wall 112 where the shape of the tube can be, for example, rectangular, cylindrical, etc., with various cross-sectional configurations. The tube 100 is manufactured from an electrically insulating material, for instance glass, ceramic, plastic, etc. At each end 110, 120 of the tube 100, counter bores 125*a*, 125*b* are disposed in the sides of the tube walls 100*a*. The counter bores 125*a*, 125*b* provide a more consistent point of connection between the solder or other conductive material and the fusible element as shown below with reference to FIG. 2C. Although the counter bores 125*a* and 125*b* are shown having substantially the same geometry, alternative geometries may be employed which may be on both ends of the tube 100, one end of the tube 100 and/or may or may not be around the circumference of the tube.

FIG. 2C illustrates a side view of an assembled fuse 200 utilizing a hollow tube 210 configured with the counter bores 225*a*, 225*b* at respective ends. Fuse 200 includes a first end cap 230, a second end cap 240 and a fusible element 220 disposed within the hollow tube 210 which forms an electrical connection between the end caps 230 and 240. The counter bores 225*a*, 225*b* are disposed in walls 210*a* of the tube at each end. The fusible element 220 extends diagonally through the cavity of the tube body 210. End caps 230 and 240, made from an electrically conductive material, are positioned on the two ends of the tube body 210 to form electrical contact with the fusible element 220 to form a mechanically rigid connection with the walls 210*a* of tube 210. The fusible element 220 is connected to the end caps 230, 240 by means of solder 255 which fills the spaces defined by the counter bores 225*a*, 225*b*. In particular, the counter bores 225*a*, 225*b* in the walls 210*a* of tube body 210 are configured as having a step configuration. These counter bores provide extra space for the solder 255 to fill at the ends of the tube body 210. This extra solder covers a length of the fusible element 220 to provide a more reliable connection between the fusible element 220 and the respective end cap 230, 240.

Figure 3:
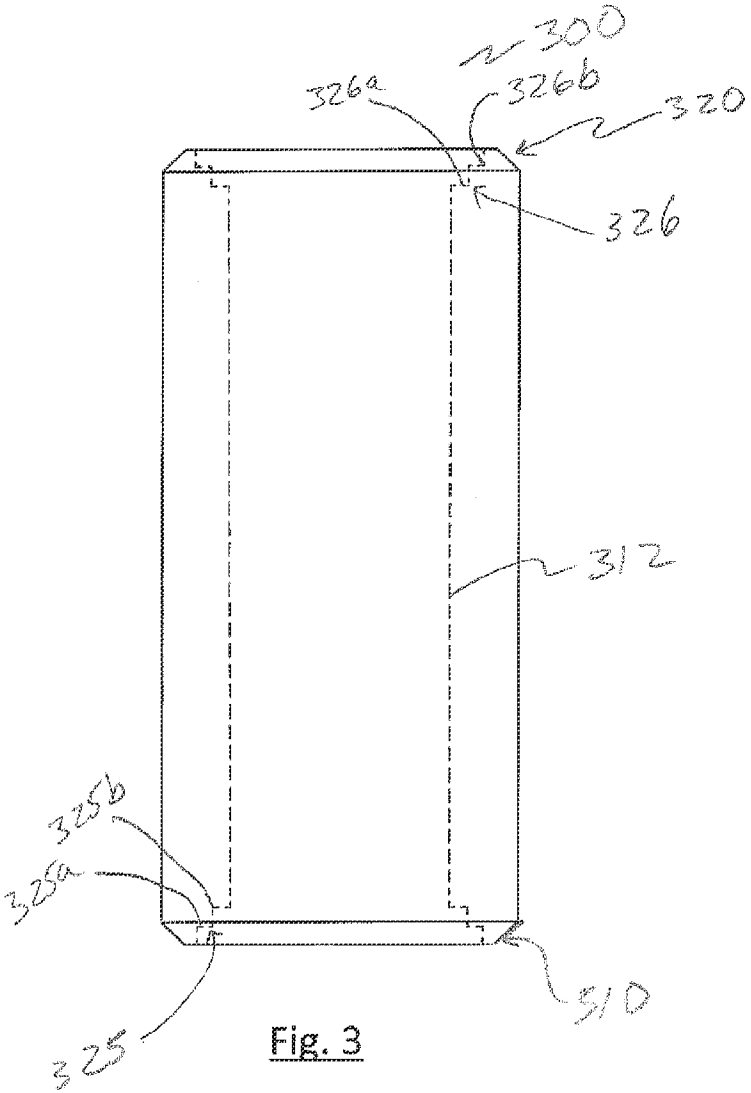
FIG. 3 illustrates a fuse body having an alternative configuration of counter bores in accordance with an embodiment of the present disclosure.

FIG. 3 illustrates a tube body 300 having an alternative configuration of counter bores 325, 326. In particular, tube body 300 has a first end 310 and a second end 320. Each end includes counter bores 325, 326 formed into tube wall 312. Counter bore 325 is defined by a first step 325*a* and a second step 325*b*. Counter bore 326 is defined by a first step 326*a* and a second step 326*b*. Similar to the tube body 210 shown in FIGS. 2A-2C, the counter bores 325, 326 at each end of tube body 300 provide extra space for the solder to cover a fusible element disposed inside the tube which provides a more reliable connection between the fusible element and respective end caps attached to the tube.

Figures 4A, 4B, 5A, 5B, 6A, 6B, 7A, 7B, 8A, 8B:
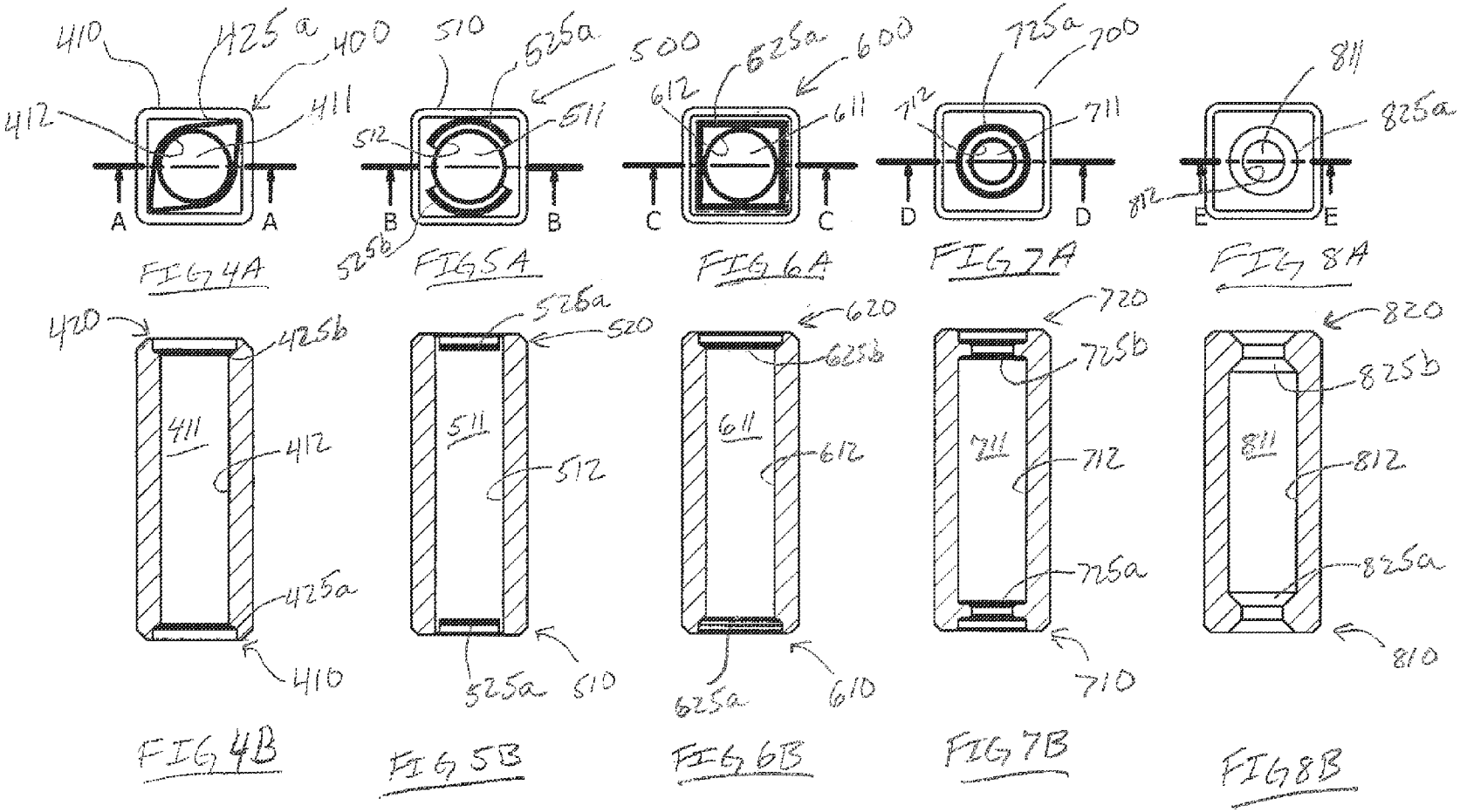
FIGS. 4A, 4B illustrates a fuse body having an alternative configuration of counter bores in accordance with an embodiment of the present disclosure.
FIGS. 5A, 5B illustrates a fuse body having an alternative configuration of counter bores in accordance with an embodiment of the present disclosure.
FIGS. 6A, 6B illustrates a fuse body having an alternative configuration of counter bores in accordance with an embodiment of the present disclosure.
FIGS. 7A, 7B illustrates a fuse body having an alternative configuration of counter bores in accordance with an embodiment of the present disclosure.
FIGS. 8A, 8B illustrates a fuse body having an alternative configuration of counter bores in accordance with an embodiment of the present disclosure.

FIG. 4A is an end view of a tube body having an alternative configuration of counter bores. In particular, tube body 400 includes a cavity 411 defined by interior wall 412. The interior cavity may be circular, rectangular or other shape configured to house a fusible element. A first end 410 of the tube 400 includes a counter bore 425*a* formed into the wall 412 of tube 400. Counter bore 425*a* is shown as having an extended oval-like pointed shape. FIG. 4*b* is a cut away view of tube 400 taken along lines A-A of FIG. 4A. Tube 400 includes first end 410 and second end 420. An interior wall 412 defines cavity 411 which is configured to receive a fusible element (not shown). Counter bore 425*a* is disposed in wall 412 at end 410 of tube 400. Counter bore 425*b* is disposed in wall 412 at end 420 of tube 400. The counter bores 425*a* and 425*b* provide a more consistent point of connection between the solder or other conductive material and a fusible element.

FIG. 5A is an end view of a tube body having an alternative configuration of counter bores. In particular, tube body 500 includes a cavity 511 defined by interior wall 512. The interior cavity may be circular, rectangular or other shape configured to house a fusible element. First end 510 of the tube 500 includes a counter bore formed into wall 512. The counter bore is defined by a pair of circular portions 525*a*, 525*b* disposed along first end 510. FIG. 5*b* is a cut away view of tube 500 taken along lines B-B of FIG. 5A. Tube 500 includes first end 510 and second end 520. The interior wall 512 defines cavity 511 which is configured to receive a fusible element (not shown). A first end 510 of tube 500 includes a counter bore 525*a* disposed in wall 512. A second end 520 of tube 500 includes a counter bore 526*a* disposed in wall 512.

FIG. 6A is an end view of a tube body having an alternative configuration of counter bores. In particular, tube body 600 includes a cavity 611 defined by interior wall 612. The interior cavity may be circular, rectangular or other shape configured to house a fusible element. First end 610 of the tube 600 includes a counter bore 625*a* formed into the wall 612 of tube 600. Counter bore 625*a* is shown as having a generally square or rectangular shape. FIG. 6*b* is a cut away view of tube 600 taken along lines C-C of FIG. 6A. Tube 600 includes first end 610 and second end 620. Interior wall 612 defines cavity 611 and includes counter bore 625*a* disposed in wall 612 at end 610 of tube 600. Similarly, counter bore 625*b* is disposed in wall 612 at end 620 of tube 600.

FIG. 7A is an end view of a tube body having an alternative configuration of counter bores. In particular, tube body 700 includes a cavity 711 defined by interior wall 712. The interior cavity may be circular, rectangular or other shape configured to house a fusible element. A first end 710 of the tube 700 includes a counter bore 725*a* formed into the wall 712. Counter bore 725*a* is shown as having a generally circular shape.

FIG. 7*b* is a cut away view of tube 700 taken along lines D-D of FIG. 7A. Tube 700 includes first end 710 and second end 720. Interior wall 712 defines cavity 711 which is configured to receive a fusible element (not shown). Counter bore 725*a* is disposed in wall 712 at end 710 of tube 700. Similarly, counter bore 725*b* is disposed in wall 712 at end 720.

FIG. 8A is an end view of a tube body having an alternative configuration of counter bores. In particular, tube body 800 includes a cavity 811 defined by interior wall 812. The interior cavity may be circular, rectangular or other shape configured to house a fusible element. A first end 810 of the tube 800 includes a counter bore 825*a* formed into the wall 812. Counter bore 825*a* is shown as having a partial cone shape as can be seen more clearly in FIG. 8*b* which is a cut away view of tube 800 taken along lines E-E of FIG. 8A. Tube 800 includes first end 810 and second end 820. Interior wall 812 defines cavity 811 which is configured to receive a fusible element (not shown). Counter bore 825*a* is disposed in wall 812 at end 810 of tube 800. Similarly, counter bore 825*b* is disposed in wall 812 at end 820.

In this manner, each of the counter bore configurations illustrated above with reference to FIGS. 4-8 provide a more consistent point of connection between the solder or other conductive material and a fusible element.

While the present invention has been disclosed with reference to certain embodiments, numerous modifications, alterations and changes to the described embodiments are possible without departing from the sphere and scope of the present invention, as defined in the appended claim(s). Accordingly, it is intended that the present invention not be limited to the described embodiments, but that it has the full scope defined by the language of the following claims, and equivalents thereof.

What is claimed is:

1. A fuse comprising:

a hollow body defining a central cavity, said hollow body having at least one end, said central cavity defining a perimeter in said at least one end, said hollow body further having a counter bore, said counter bore encircling said perimeter;

a fusible element passing through the body; and a cap disposed on said end of said hollow body, wherein solder forms an electrical connection between said cap and said fusible element proximate said counter bore, a portion of said fusible element is substantially disposed within said counter bore for connection to said solder, said solder completely fills said counter bore, wherein said central cavity is defined by an inner wall of said hollow body, said counter bore disposed within said inner wall at said end of said hollow body, wherein said counter bore includes a first portion and a second portion, said first portion adjacent to said cap, said second portion adjacent to said first portion, said first portion having a first width perpendicular to a longitudinal axis of said central cavity and a first length parallel to said longitudinal axis of said central cavity, said second portion having a second width perpendicular to said longitudinal axis of said central cavity and a second length parallel to said longitudinal axis of said central cavity, wherein said first width is wider than said second width.

2. The fuse of claim 1 wherein said portion of said fusible element is a first end of said fusible element substantially disposed within said counter bore for connection to said solder and said cap.

3. The fuse of claim 1 wherein said end is a first end, said cap is a first cap and said fusible element has a first and second end, said first end of said fusible element forming said electrical connection with said first cap, said fuse further comprising a second end of said hollow body and a second cap, said second cap disposed on said second end of said hollow body wherein said solder forms an electrical connection between said second cap and said second end of said fusible element.

4. The fuse of claim 3 wherein said first end of said fusible element is substantially disposed within said counter bore for connection to said solder and said first cap.

5. The fuse of claim 3 wherein said counter bore is a first counter bore, said second end of said hollow body having a second counter bore completely filled with solder forming the electrical connection between said second cap and said second end of said fusible element.

6. The fuse of claim 3 wherein said second end of said fusible element is disposed at least partially in said second counter bore for connection to said solder and said second cap.

7. A fuse comprising:

a hollow body having an interior wall that defines a central cavity, said hollow body having a first end and a second end, said central cavity defining a perimeter in said first end;

a counter bore disposed within said interior wall at said first end, said counter bore encircling said perimeter;

a solder material completely filling said counter bore;

a fusible element disposed within said central cavity and extending from said first end of said hollow body to said second end of said hollow body, said fusible element having a first end attached to said solder material and substantially disposed within said counter bore; and a cap attached to said first end of said hollow body, said solder material forming an electrical connection between said cap and said first end of said fusible element, wherein said counter bore includes a first portion and a second portion, said first portion adjacent to said cap, said second portion adjacent to said first portion, said first portion having a first width perpendicular to a longitudinal axis of said central cavity and a first length parallel to said longitudinal axis of said central cavity, said second portion having a second width perpendicular to said longitudinal axis of said central cavity and a second length parallel to said longitudinal axis of said central cavity, wherein said first width is wider than said second width.

8. The fuse of claim 7 wherein said counter bore defines a pocket within said inner wall.

9. The fuse of claim 7 wherein said first end of said fusible element is substantially disposed within said counter bore for connection to said solder material and said cap.

10. The fuse of claim 7 wherein said counter bore is a first counter bore, said solder material is a first solder material, said cap is a first cap and said fusible element has a second end, said fuse further comprising:

a second counter bore disposed within said interior wall at said second end of said hollow body;

a second solder material disposed within said second counter bore; and a second cap attached to said second end of said hollow body, said second solder material forming an electrical connection between said second cap and said second end of said fusible element.

11. The fuse of claim 10 wherein said second end of said fusible element is disposed at least partially in said second counter bore for connection to said solder material and said second cap.

12. The fuse of claim 10 wherein said second counter bore defines a pocket within said inner wall.

13. A fuse comprising:

a hollow body having an interior wall that defines a central cavity, said hollow body having a first end and a second end, said central cavity defining a perimeter in said first end;

a counter bore disposed within said interior wall at said first end, said counter bore completely encircling said perimeter;

a solder material completely filling said counter bore;

a fusible element disposed within said central cavity and extending from said first end of said hollow body to said second end of said hollow body, said fusible element having a first end attached to said solder material and substantially disposed within said counter bore; and a cap attached to said first end of said hollow body, said solder material forming an electrical connection between said cap and said first end of said fusible element, wherein said counter bore includes a first portion and a second portion, said first portion adjacent to said cap, said second portion adjacent to said first portion, said first portion having a first width perpendicular to a longitudinal axis of said central cavity and a first length parallel to said longitudinal axis of said central cavity, said second portion having a second width perpendicular to said longitudinal axis of said central cavity and a second length parallel to said longitudinal axis of said central cavity, wherein said first width is wider than said second width.

14. The fuse of claim 13 wherein said perimeter has a first geometry and said counter bore defines a second geometry, wherein said first geometry is different than said second geometry.

15. The fuse of claim 14 wherein said second end of said hollow body having a second counter bore defines a pocket within said inner wall and said pocket is filled with said solder material.

16. The fuse of claim 1 wherein said solder completely covers said portion of said fuse element substantially disposed within said counter bore.

17. The fuse of claim 1 wherein said counter bore widens the central cavity in a direction perpendicular to a longitudinal axis of the central cavity.

18. The fuse of claim 1 wherein said solder fills a portion of said central cavity.

19. The fuse of claim 1 wherein said counter bore is disposed within said inner wall such that a first distance between corresponding portions of said inner wall forming said counter bore is larger than a second distance between corresponding portions of said inner wall forming said central cavity.

20. The fuse of claim 1, wherein the first portion of the counter bore forms a first step and the second portion of the counter bore forms a second step.

21. The fuse of claim 1, wherein the first portion of the counter bore comprises a partial cone shape.

22. The fuse of claim 21, wherein the counter bore includes a third portion adjacent to said central cavity, said third portion comprising a partial cone shape.

* * * * *